United States Patent [19]

Pacht et al.

[11] 4,128,207

[45] Dec. 5, 1978

[54] FLUID DELIVERY SYSTEM

[76] Inventors: Amos Pacht, 9218 Benning, Houston, Tex. 77071; Herbert L. Johnson, 8210 Beechnut, Houston, Tex. 77036

[21] Appl. No.: 727,635

[22] Filed: Sep. 29, 1976

[51] Int. Cl.[2] ..... B05C 7/02

[52] U.S. Cl. ..... 239/186; 239/227; 134/167 C

[58] Field of Search ..... 239/186, 187, 227; 134/22 C, 167 C, 168 C, 172

[56] References Cited

U.S. PATENT DOCUMENTS

| | | | |
|---|---|---|---|
| 3,027,095 | 3/1962 | Paasche | 239/227 X |
| 3,351,289 | 11/1967 | Demaison | 239/227 X |
| 3,439,912 | 4/1969 | Berger | 239/187 X |
| 3,827,633 | 8/1974 | Kouno et al. | 239/187 X |

*Primary Examiner*—Robert W. Saifer

[57] ABSTRACT

A fluid delivery system is disclosed utilizing a high pressure cleaning fluid, such as a blast of high pressure water, to remove material from the inside wall of the stator of a relatively large electric motor. In the preferred embodiment of this invention illustrated, the fluid delivery system includes a nozzle carriage having a high pressure nozzle movable along the length of the inside wall of the stator to be cleaned, a rotating carriage frame for rotating the nozzle about the inside wall of the stator to be cleaned, a vertically movable wall upon which the rotating carriage frame is mounted, and a base frame or skid on which the vertically moving wall is mounted. The nozzle can be positioned to move along a desired longitudinal path along the inside of the stator, such as along longitudinal grooves where the material to be removed is located.

39 Claims, 14 Drawing Figures

FIG. 1
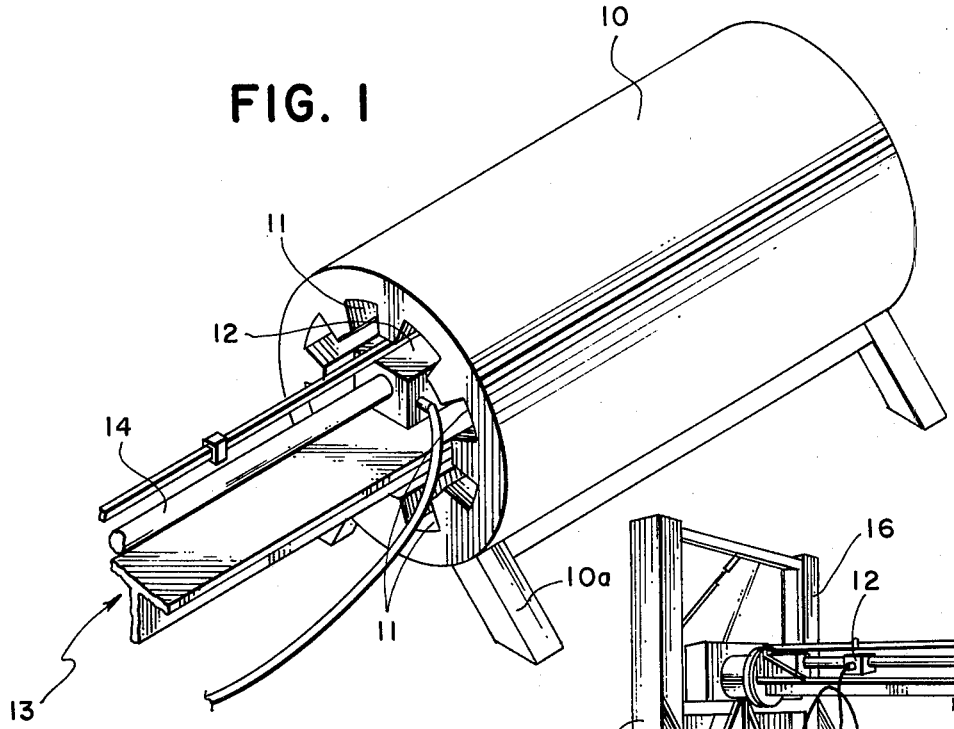
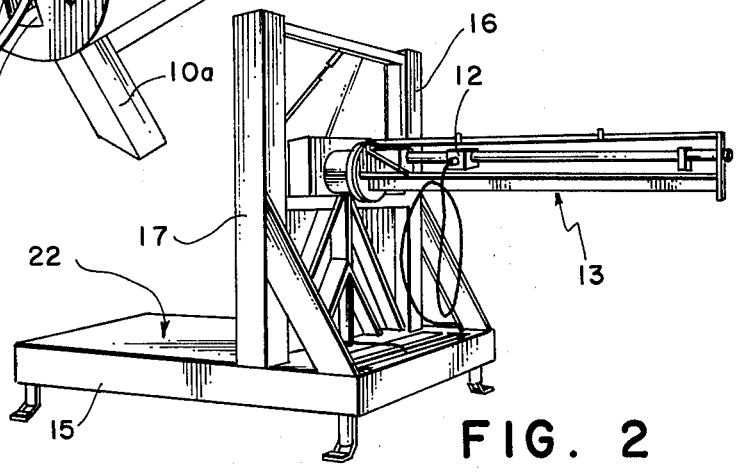
FIG. 2
FIG. 3
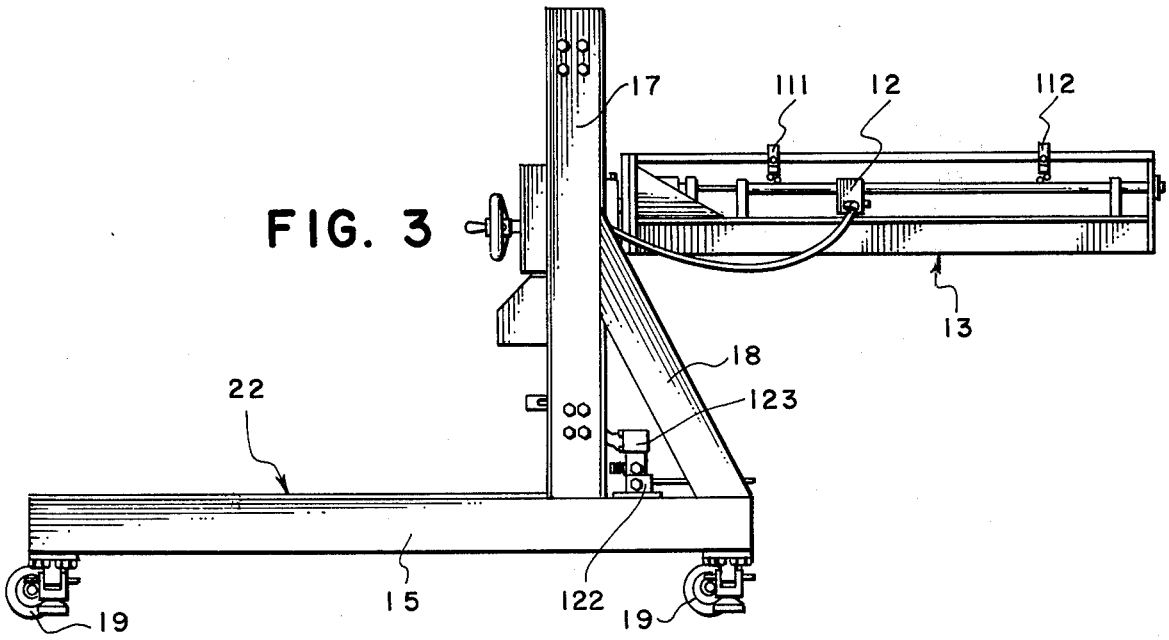

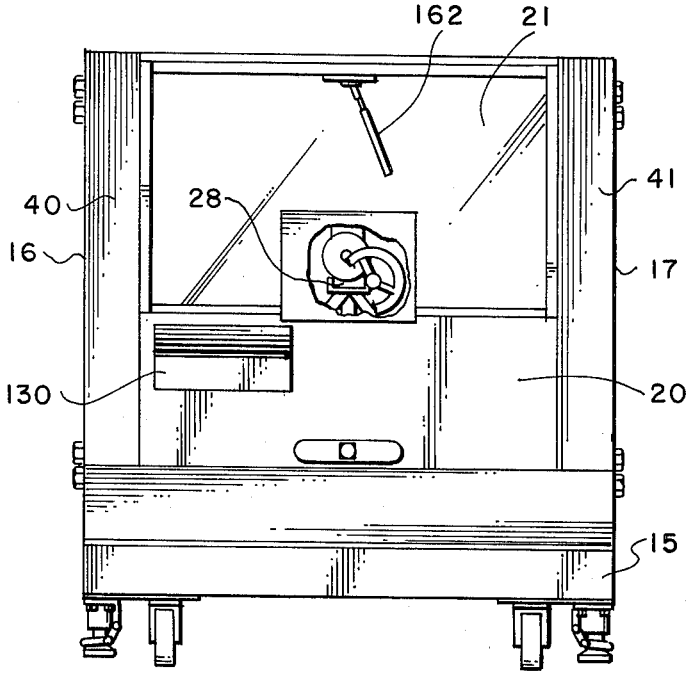
FIG. 4
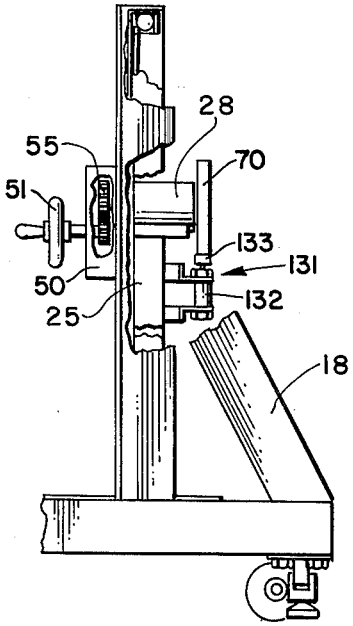
FIG. 5
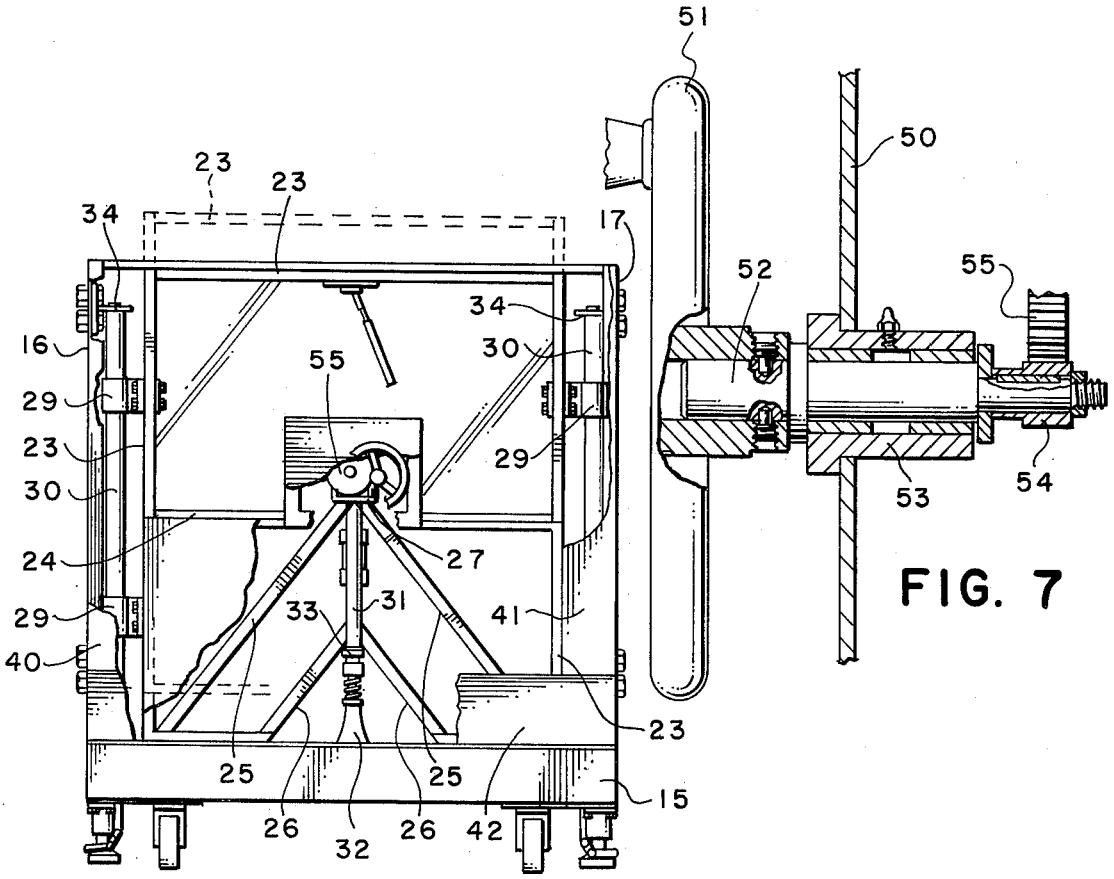
FIG. 6
FIG. 7

FLUID DELIVERY SYSTEM

This invention relates to a fluid delivery system and in one of its aspects to such a system utilizing the high pressure delivery of fluid to remove a material from the inside wall of the stator of a relatively large electric motor.

Relatively large electric motors, for example, motors which may be 6 feet in diameter or more, may include a plurality of longitudinal grooves or slots spaced about the inside wall of a stationary stator of the motor. The grooves are provided with the stator coil material which may be press-fitted or glued into the grooves. Because the stator housing is a relatively large and expensive object, and has a useful life greater than the other component parts of the motor, it is common to rebuild or refurbish an electric motor by removing the old stator windings from the inside of the stator housing, cleaning the inside walls of the stator, and then adding new windings. The process of removing the old windings from the longitudinal slots of the stator is time consuming and, prior to the present invention, was generally accomplished by hand or by special tools, or by heating the glue in the slots in special ovens, procedures that were generally not satisfactory.

The present invention is directed to a fluid delivery system and apparatus therefore, and the method of utilizing the same, for use in removing material, such as coil windings, accumulated glue and dirt, from the inside of the longitudinal slots in a motor stator by the application of high pressure fluid directed along the length of each of the slots. For this purpose the high fluid delivery system provided includes an outlet nozzle for providing a relatively high fluid pressure, i.e., 10,000 PSI or more, a high pressure pump, and a valve means between the pump and the outlet nozzle for selectively switching the flow of fluid from said nozzle to a relatively low pressure or "dump" outlet. The high pressure outlet nozzle is mounted on a nozzle carriage which is mounted for movement along the length of rotatable, longitudinally extending carriage frame. The carriage frame is mounted on a vertical wall which preferably is vertically adjustable to adjust the height of the carriage frame, and the vertical wall is mounted on a base frame so that the longitudinally extending carriage frame can be inserted into and along the length of the inside of the motor stator to be refurbished and cleaned. In order to permit the operator to reasonably accurately position the high pressure outlet nozzle with respect to a slot in the stator to be worked on, it is preferred that the vertically movable wall include a windshield and that the appropriate control apparatus for positioning the nozzle and actuating the fluid delivery mechanism be mounted on the vertically movable wall on the side opposite to which the elongated carriage frame is mounted. Also, it is preferred that the elongated carriage frame be mounted in a manner so that means may be provided on the operator's side of the vertical wall which permits the operator to rotate and position the carriage frame with a substantial mechanical advantage in order to provide fairly precise control over the rotation of the carriage frame.

Also, means is provided on the carriage frame for moving the nozzle carriage longitudinally along the carriage frame at a desired rate once the nozzle is positioned correctly with respect to the longitudinal slot being worked on. The travel of the nozzle carriage along the carriage frame preferably is reversible when the nozzle carriage approaches the respective ends of the carriage frame. Of course, various details and features of the present invention are more fully explained in connection with the description of the detailed drawings of this invention.

In the drawings, wherein a preferred embodiment of this invention is illustrated, and wherein like reference numerals are used throughout to designate like parts;

FIG. 1 is a view in elevation illustrating the use of the present invention for removing material from the interior of a motor stator;

FIG. 2 is a perspective view in elevation illustrating the preferred form of the apparatus employed in this invention FIG. 3 is a side view in elevation of the apparatus of FIG. 2;

FIG. 4 is a rear view of the apparatus of FIG. 2 in partial cutaway;

FIG. 5 is a partial side view of the apparatus of FIG. 2 having a partial cutaway;

FIG. 6 is a view similar to FIG. 4 with an additional portion cutaway;

FIG. 7 is a view partially in elevation and partially in section of the apparatus employed to rotate the carriage frame of the apparatus in FIG. 2;

Figure 8:
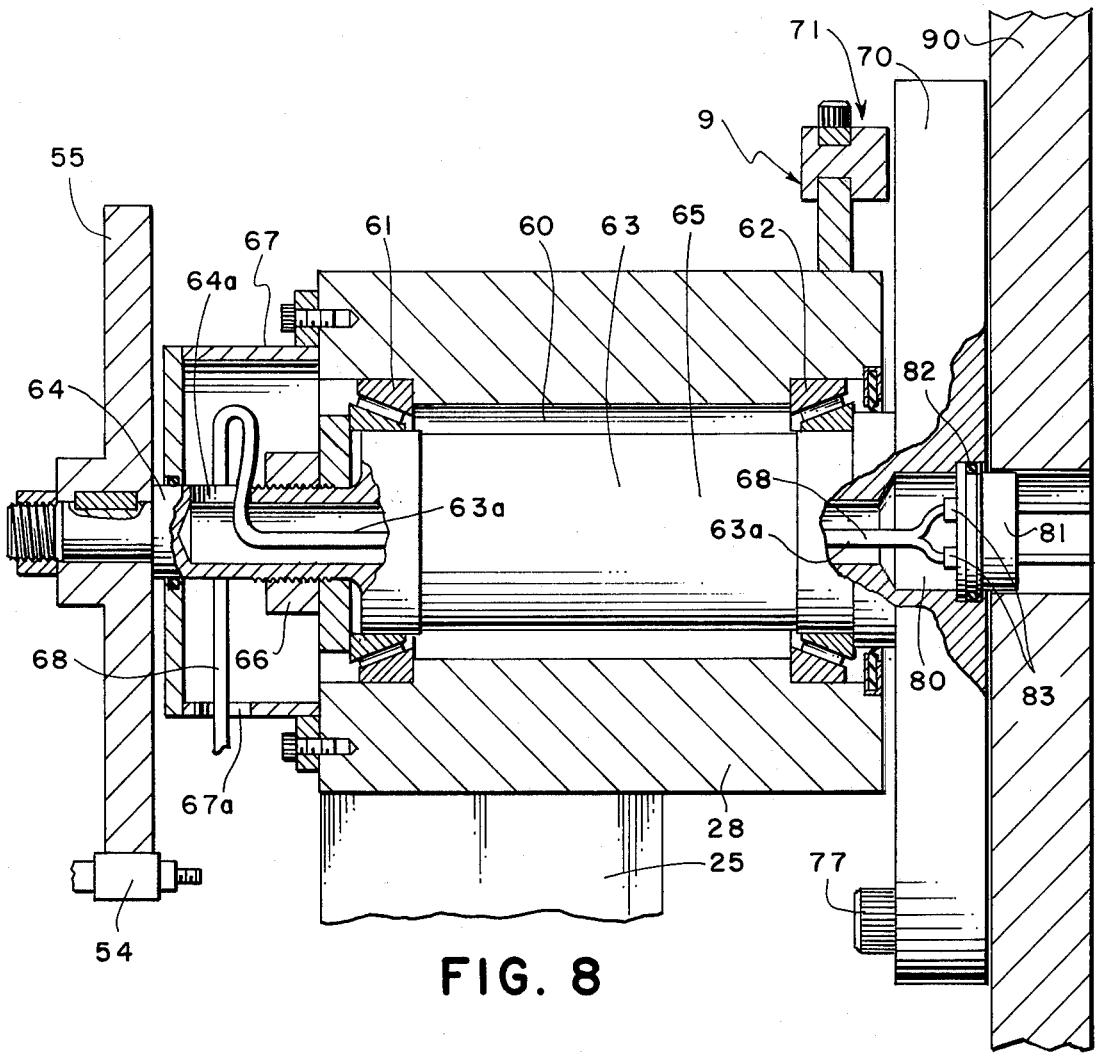
FIG. 8 is a view partly in elevation and partly in section illustrating the details of the mounting apparatus for mounting the carriage frame on the apparatus in FIG. 2.

Referring now to FIG. 1 of the drawings, a motor stator is represented by a reference numeral 10 as being supported on a cradle or stand **10*a* and includes a plurality of slots or grooves 11 in its interior in which the stator windings (not shown) of a motor would normally be provided, as is well known in the art. It is to be understood that the stator 10 shown in FIG. 1 is only for the purposes of illustration and these devices can take a number of different shapes and are of many different sizes. As illustrated in FIG. 1, by use of the present invention a nozzle carriage 12 including a high pressure outlet nozzle (not shown in FIG. 1), both of which are more fully described in detail below, may be inserted into the interior of stator 10 so that the nozzle may be positioned to move along each of the slots 11 to cause undesirable material, i.e., old windings, dirt, glue, etc., to be dislodged from the slots and be removed from the interior of the stator 10. As more fully explained below nozzle carriage 12 is mounted on a carriage frame 13 including a threaded rod 14 so that the carriage may be reciprocated back and forth along rod 14 so to move the outlet nozzle along the length of each of the slots. Also the entire carriage frame 13 is rotatable about a longitudinal axis parallel to the axis of stator 10 over at least 360°, and preferably about 370°, in either direction to permit the high pressure nozzle outlet to be positioned adjacent to each of the slots 11**.

FIG. 2 illustrates a suitable apparatus for supporting the carriage from 13 to permit it to be inserted along with the nozzle carriage 12 into the interior of stator 14. The apparatus in FIG. 2 includes a base frame or skid assembly 15 having spaced apart vertical frame members 16 and 17 which are supported by two diagonal struts 18, only one of which is shown in FIG. 3. Base frame 15 may be supported by a plurality of rollers or wheels 19 to permit the entire structure to be moved between job locations without the use of a crane or forklift.

As illustrated in FIGS. 4 and 6, vertical wall 20 is supported by frame 15 between vertical members 16 and 17, and includes a windshield 21 through which an operator standing in the area 22 of base frame 15 may watch the operation and movement of nozzle carriage 12 and carriage frame 13. As illustrated in FIGS. 5 and 6, a vertical wall 20 is comprised of a generally rectangular frame member 23 and a central, transverse frame member 24 which supports the lower portion of windshield 21. The vertical wall also includes four internal diagonal frame members, such as two relatively long members 25 and two shorter members 26. As illustrated in FIG. 6 a U-shaped support member 27 is supported by diagonal frame members 25 at the apex where they are joined, and member 27 in turn supports a cylindrical hub 28 to which longitudinally extending frame assembly 13 is mounted as hereinafter described.

In addition, each of the vertically extending frame members 23 and vertical wall 20 are connected through spaced apart slidable sleeves 29, as illustrated in FIG. 6, to the spaced apart vertically extending guide rods 30, one of which is mounted on each of the vertical frame members 16 and 17. Thus, the vertical wall 20 can be moved vertically as illustrated by the dotted line position illustrated in FIG. 6 to also move diagonal frame members 25 and support plate 27 vertically. As also illustrated in FIG. 6, a vertical rod 31 is connected to diagonal frame members 25 adjacent their apex and also to diagonal frame members 26 adjacent the apex at which they are joined. A jacking mechanism 32 may be inserted underneath the lower end 33 of vertical rod 31 to provide a means for raising and lowering the vertical wall 20 with limits established by stops 34 provided at the top of each vertical guide rod 30.

Thus, with the arrangement described the operator of the fluid delivery system utilized in the high pressure fluid delivery apparatus of FIG. 2 can actuate jacking mechanism 32 to change the vertical orientation of carriage frame 13 and nozzle carriage 12 with respect to the inside wall of a stator being cleaned. Jacking mechanism 32 may be a screw type jack either manually, pneumatically or hydraulically actuated, or could be replaced with a hydraulic pneumatic cylinder-piston arrangement, although the screw is easier to control with respect to vertical positioning.

Of course, as illustrated in FIG. 4, it is desirable to provide front shrouds 40 and 41 extending along vertical frame members 16 and 17, and a transverse front shroud member 42 in order to improve the overall appearance of the apparatus and to prevent water that is sprayed back during operation from directly striking the operator.

As also illustrated in FIGS. 5 and 7, a box-like structure 50 is mounted on the center frame member 24 and supports a rotatable steering wheel 51 connected to a shaft 52 which is mounted through a bushing 53 in the outside wall of box 50. The end of shaft 52 opposite that on which wheel 51 is mounted includes, inside of box 50, a small gear 54 which follows the rotation of shaft 52 and wheel 51. Wheel 51 and bushing 53 are mounted off-center with respect to the center of box 50 so that gear 54 engages a larger gear 55 mounted in the approximate center of box 50 as hereinafter explained.

Referring now to FIG. 8, the details of hub 28 supported by the diagonal frame members 25 are shown. As illustrated therein, hub 28 has a cylindrical bore 60 in which spaced apart roller bearings 61 and 62 are mounted to support a shaft 63 for rotation. Shaft 63 includes a relatively smaller diameter portion 64 extending from the side of the hub facing the operator of the apparatus in FIG. 2 and a relatively large diameter center portion 65 which is supported by bearings 61 and 62, and also includes a center bore **63*a* through it, and an opening 64*a* in portion 64 of shaft 63. Portion 64 of shaft 63 includes threads for receipt of a nut 66 securing the shaft to the rotatable portion of bearing 61. A housing 67 including an opening 67*a* is mounted on hub 28 over a portion of the end 64 of shaft 63 and a relatively large gear 55 is connected to the end of the shaft extending from housing 67. As illustrated in FIG. 8 gear 55 meshes with gear 54 so that when the steering wheel 51 is rotated gear 55 and shaft 63 are also rotated therewith. Openings 64*a* and 67*a* in shaft 63 and housing 67 respectively are provided to permit an air hose 68 (or a plurality of such hoses) to pass into housing 67, and into and through shaft 63**.

Figure 9:
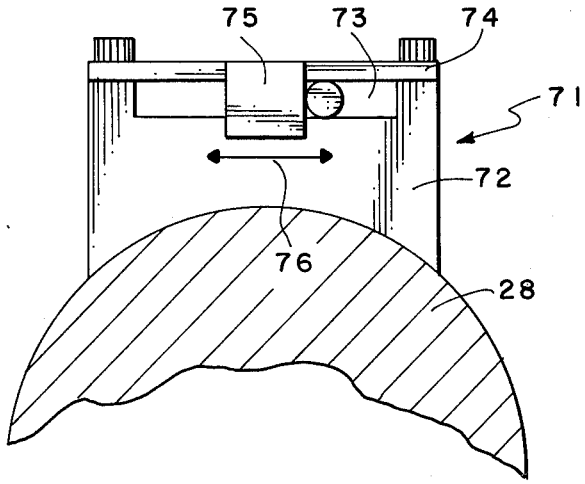
FIG. 9 is a front view taken in area 9 in FIG. 8.

The end of shaft 63 opposite to end 64 is connected to a relatively large disc 70 for rotation thereof. As illustrated in FIG. 9 a movable stop 71 is provided and is mounted on top of hub 28. Stop 71 includes a vertical plate 72 having a recessed portion enclosed by a top plate 74 to form a slot 73. A slidable stop member 75 is mounted in slot 73 to move back and forth as indicated by arrow 76. A bolt head 77 is mounted on disc 70 and bolt head 77 will engage stop 75 during the rotation of disc 70 in either direction if the disc is rotated far enough. Since stop member 75 can be caused to slide to either side of slot 73 in response to the abutment by bolt head 77, disc 70 is permitted to rotate slightly greater than 360°, for example 370° in either direction before the stop is effective in preventing further rotation of disc 70.

Disc 70 also includes an opening 80 for communication with the center bore **63*a* and shaft 63, and an end cap 81 having a suitable O-ring seal 82 to prevent the passage of water into opening 80 is mounted in opening 80 as illustrated in FIG. 8. Cap 81 may include a plurality of coupling members 83 (although only two such coupling members are shown, a larger or smaller number may be provided within the available space as required for a specific application) through which air and/or electrical lines may be conducted while also maintaining a watertight seal, and cap 81 projects outwardly from disc 70 to also function as a dowel to center plate 90 which is mounted on disc 70 for rotation therewith. As hereinafter explained plate 90 functions as an end and mounting plate for carriage frame 18 and permits the carriage frame to be mounted for rotation with disc 70. Suitable spaced apart bolts (not shown) may be provided for mounting plate 90 to disc 70**.

Figure 10:
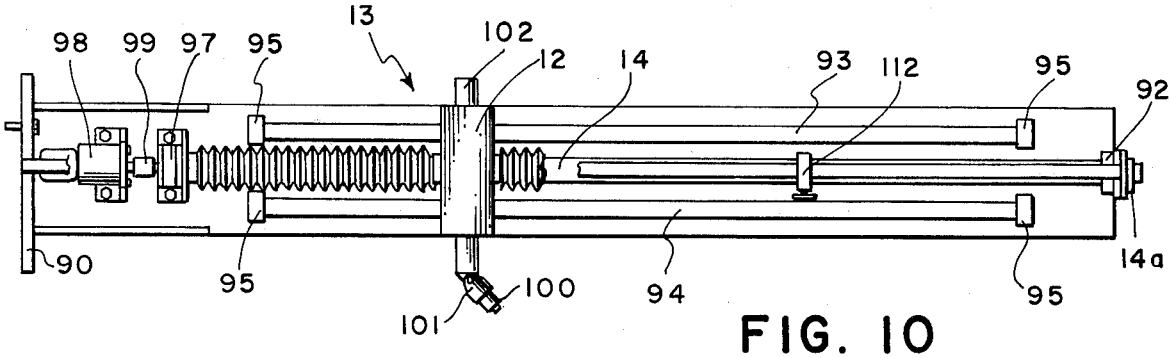
FIG. 10 is a front view of the carriage frame of the apparatus in FIG. 2.
Figure 11:
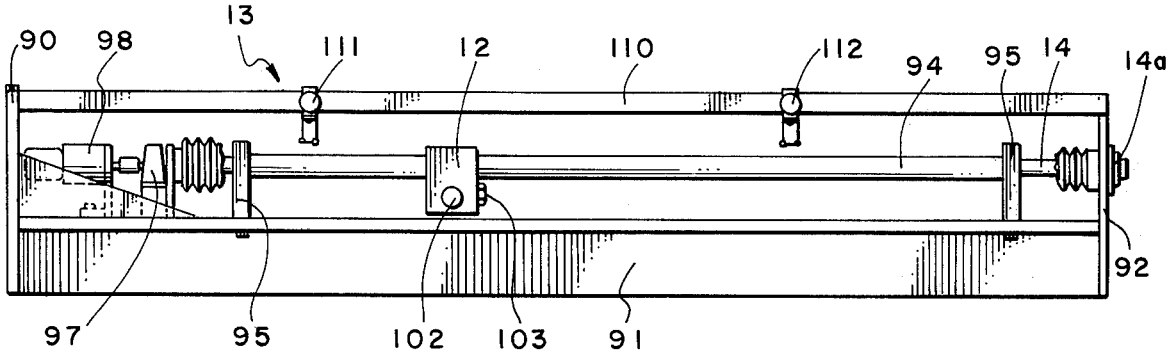
FIG. 11 is a side view in elevation of the carriage frame of FIG. 10.

Referring now to FIGS. 10 and 11, the details of carriage frame 13 are illustrated. Carriage frame 13 includes a main longitudinal beam member 91 which is in the form of a T in cross section (see FIG. 1). Plate 90 is mounted at one end to beam 91 and a second plate 92 is mounted on the opposite end thereof. Two spaced apart guide rods 93 and 94 are mounted on mounting blocks 95 on opposite sides of the center of beam 91, and on the top thereof, and each of rods 93 and 94 extend along a substantial part of the length of beam 91. Threaded rod 14 is mounted between guide rods 95 and 94 and extends along the length of beam 91 and above the center thereof. Threaded rod 14 is supported on one end by a bearing 14*a* mounted on plate 92 and at the other end by a bearing and bushing 97, and is rotatable. An air motor 98 is connected through a coupling 99 to the end of threaded rod 96 supported by bushing 97 and air motor 98 is actuated by the air hoses extending through cap 81 as previously described. Thus, by the rotation of air motor 98 rod 96 is caused to rotate in a desired direction.

Nozzle carriage 12 extends transversely to the length of carriage frame 13 and is slidably mounted on guide rods 93 and 94 to move along the length thereof. Also, threaded rod 96 passes through nozzle carriage 12 which includes a ball nut (not shown) for engaging the threads of threaded rod 96 to cause nozzle carriage 12 to move back and forth along the length of threaded rod 96 in response to rotation of the rod.

As illustrated in FIG. 10, a high pressure outlet nozzle 100 is mounted on a nozzle body 101 which is in turn mounted by a pivoted mounting 101*a* to an end of a shaft 102 passing through nozzle carriage 12. The pivoted mounting 101 permits the position of nozzle 100 to be adjusted through an arc of about 120°. Shaft 102 is slidably mounted in a bore passing through nozzle carriage 12 and is secured by set screw 103. By loosening set screw 103 shaft 102 can be moved in and out of the bore to change the distance from nozzle 100 to the axis of rotation of slide frame 13, and also nozzle 100 can be rotated through 360° about the axis of shaft 102. Thus, by (a) adjusting the vertical height of guide frame 13 by the actuation of jacking mechanism 32, (b) adjusting the rotational position of carriage frame 13, (c) moving shaft 102 in or out of nozzle carriage 12, (d) rotating shaft 102, and (e) pivoting nozzle 100 about pivot 101*a*, high pressure water blast nozzle 100 can be precisely positioned to direct a high pressure blast of water into each of the slots 11 of stator 10 in the manner to best accomplish its intended function.

Mounted across the top of carriage frame 13 and extending between plates 90 and 92 is a bar 110 on which limit switches 111 and 112 are slidably mounted. Limit switches 111 and 112 can be positioned along the length of the bar 110 to control the extent of travel of nozzle carriage 12 in either direction along the length of the slide frame 13. The limit switches 111 and 112 are preferably cam actuated air switches or microswitches switching electric current and can be actuated in response to being contacted by the nozzle carriage 12 or a member extending from carriage 12. Limit switches 111 and 112 can be connected to a suitable control circuit utilized to control valves which in turn control the application of air pressure to air motor 98.

Figure 12:
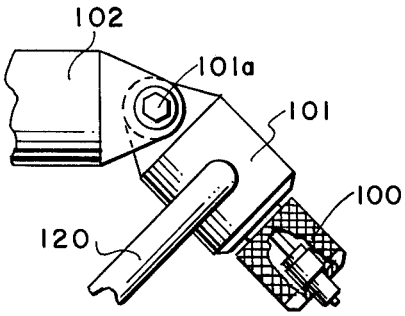
FIG. 12 is a view in elevation illustrating the nozzle carriage outlet nozzle utilized with the apparatus of FIG. 2.

FIG. 12 illustrates the details of outlet nozzle 100. As shown therein, a fluid conduit 120 is connected to body member 101 of outlet nozzle 100 for conducting high pressure fluid into the nozzle. As previously noted, this pressure may be in the order of 10,000 PSI or greater and in order to control its application a dump valve mechanism 122 is provided as shown in FIG. 3, which may be foot operated or remotely operated by an air cylinder 123. Dump valve 122 which includes a high pressure outlet and a relatively low pressure or "dump" outlet as is well known in the art is connected to a high pressure pump P (see FIG. 14) which is in turn connected to a source of fluid, such as water, to complete the fluid delivery system of the present invention, as shown schematically in FIG. 14.

Figure 13:
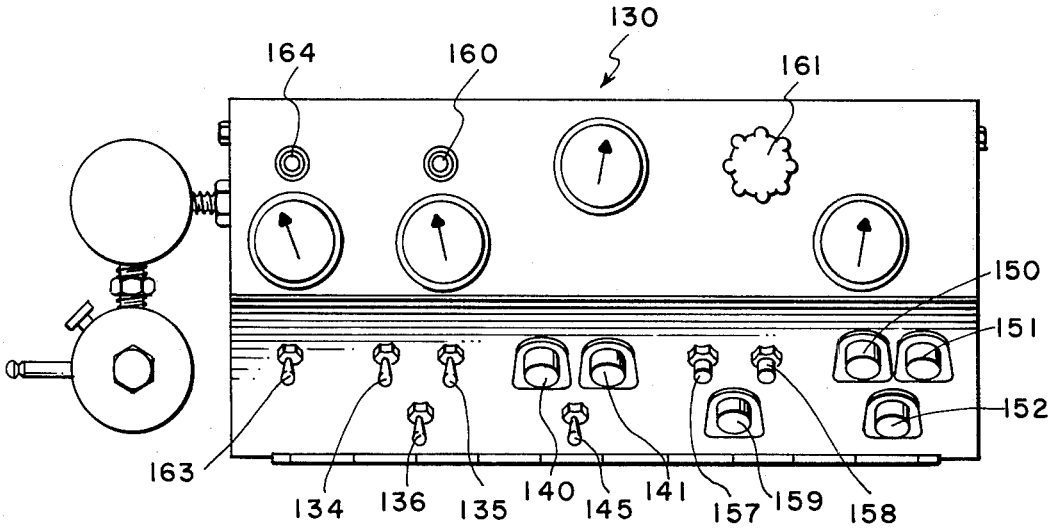
FIG. 13 is a front view in elevation of one form of the control panel utilized with the apparatus of FIG. 2.
Figure 14:
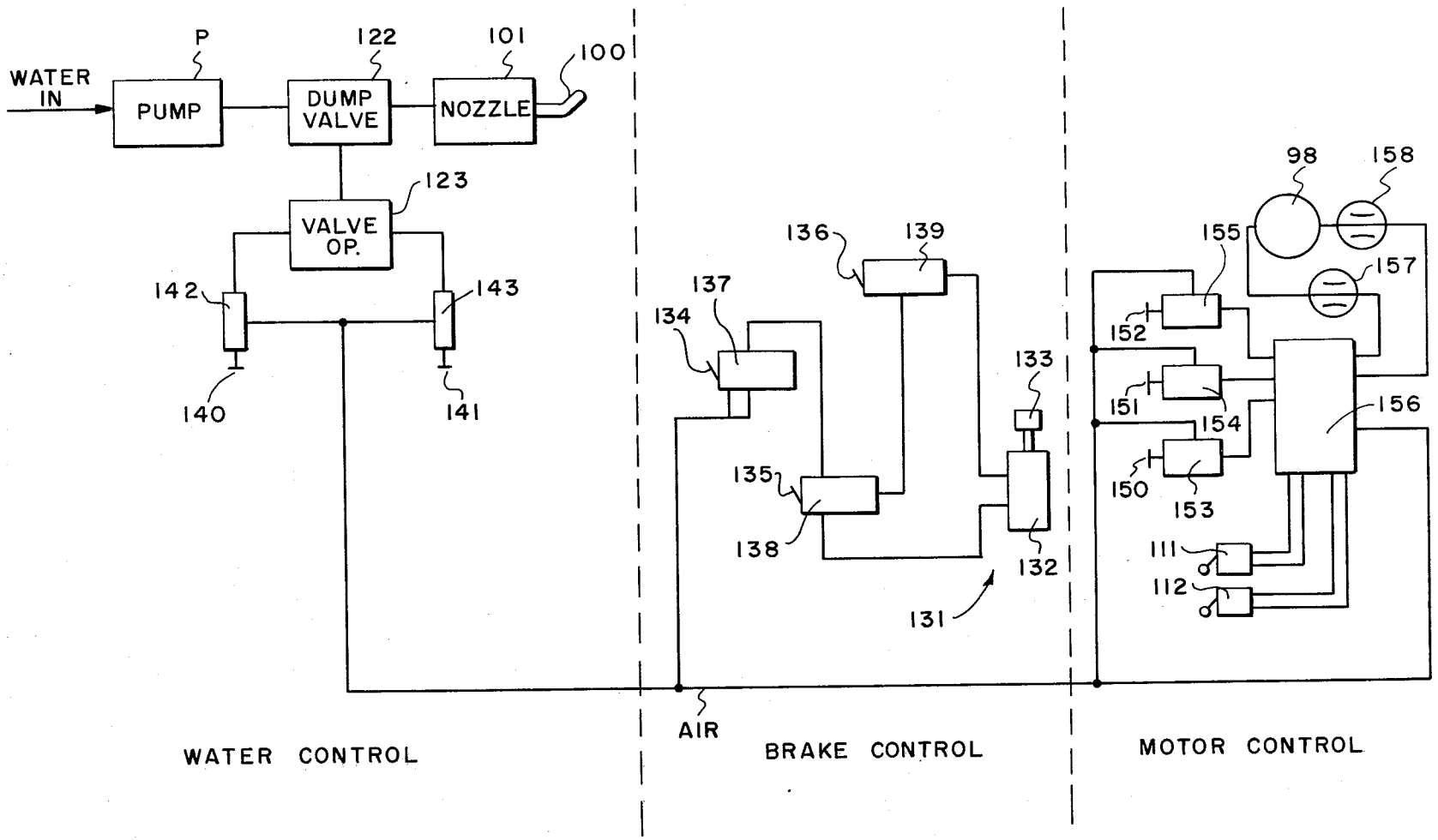
FIG. 14 is an overall schematic diagram of the control apparatus and fluid delivery apparatus utilized with the fluid delivery system of this invention.

For the purposes of illustration of a preferred arrangement of the controls utilized with this invention, a suitable control panel 130 is illustrated in FIG. 13 for use in controlling the operation of the apparatus of FIG. 2. As illustrated in FIGS. 5 and 14, a braking mechanism 131 is provided which includes an air cylinder 132 and brake shoe 133 operable under control of the air cylinder to selectively apply a braking force to disc 70. On control panel 130 toggle switches 134 and 135 can be used to turn the brake on and off, and when desired lock the brake when carriage frame 13 is in a desired rotational position. The third toggle switch 136 may be employed to permit the brake to be locked for shipping even with the supply of air to air cylinder 132 disconnected. FIG. 14 shows a preferred arrangement of the control circuitry for the braking mechanism with each of the toggle switches 134, 135 and 136 connected to operate air control valves 137, 138 and 139 respectively.

As also shown in FIGS. 13 and 14 push button switches 140 and 141 may be provided to operate pilot air valves 142 and 143 which in turn control the operation of valve operator 123. If desired, a by-pass valve operable by a switch 145 may be provided to render the high pressure water circuit inoperative for safety reasons.

Also, the controls for air motor 98 are illustrated in FIGS. 13 and 14 as including push button switches 150, 151 and 152 to start, stop and permit the change of direction of movement of air motor 98. Switches 150, 151 and 152 respectively operate pilot air valves 153, 154 and 155 which control the operation of a main air control valve 156. Forward and reversing speed controls 157 and 158, which may be variable flow regulators, may also be provided to control the speed of rotation of motor 98 in either direction and thus control the speed of movement of nozzle carrier 12. If desired a fast speed control 159 may be provided to actuate a pilot valve to apply the full fluid pressure to motor 98 and cause it to run at full speed. Also, regulator valves (not shown) may be provided in the water feed and brake control circuits to regulate the pressures applied to operate the air cylinders 123 and 132 and may be controlled by control knobs 160 and 161 on panel 130. An air operated windshield wiper 162 may also be mounted on windshield 21 and a switch 163 and speed control 164 may be mounted on control panel 130 for controlling the operation of wiper 162.

Thus, the present invention provides a fluid delivery which permits a single operator to precisely position a high pressure water blast nozzle along any one of a number of longitudinal slots in the inside wall of a large motor stator, and to vary this position as required to wash along different slots. The operator can also control the length of travel of the nozzle, and, its speed and direction of travel, and control the application of the high pressure blast of water while being protected from the high pressure spray at all times.

From the foregoing, it will be seen that this invention is one well adapted to attain all of the ends and objects hereinabove set forth, together with other advantages which are obvious and which are inherrent to the apparatus.

While the present invention is described to be used for a specific task of washing along slots inside of a motor stator, it may be used for similar operations requiring the movement of the nozzle on a longitudinal path inside a relatively large object.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A fluid delivery system for removing material from the inside wall of a motor stator including a plurality of longitudinal grooves, comprising, in combination:

a base frame;

a vertical wall mounted on said frame whereby an operator's position is provided on said frame on one side of said wall;

a horizontally extending, longitudinal rotatable carriage frame mounted on said vertical wall and extending from the side of said vertical wall opposite the side on which said operator's position is located;

means located on the operator's side of said wall for selectively rotating said carriage frame;

a nozzle carriage mounted on said carriage frame for movement along a substantial part of the length of said carriage frame;

means for selectively causing said nozzle carriage to move along said carriage frame;

a high pressure outlet nozzle mounted on said nozzle carriage;

a source of high pressure fluid including a high pressure pump; and dump valve means connected between said pump and said outlet nozzle for selectively providing a high pressure blast of fluid from said outlet nozzle.

2. The system of claim 1 wherein said vertical wall is movable vertically with respect to said base frame and further including means for selectively positioning said vertical wall at a desired vertical position with respect to said base frame.

3. The system of claim 2 wherein said vertical wall includes a pluraltiy of diagonally extending support members extending upwardly and toward the center of said wall, and further including a hub supported by said support members and a rotatable shaft extending through said hub, said carriage frame being mounted for rotation with said shaft.

4. The system of claim 1 wherein said vertical wall includes a plurality of diagonally extending support members extending upwardly toward the center of said wall, and further including a hub supported by said support members and a rotatable shaft extending through said hub, said carriage frame being mounted for rotation with said shaft.

5. The system of claim 4 wherein said rotatable shaft includes a longitudinal bore therethrough for the passage of control lines from the operator's side of said vertical wall to the carriage frame side of said vertical wall.

6. The system of claim 4 wherein said vertical wall is movable vertically with respect to said base frame and further including means for selectively positioning said vertical wall at a desired vertical position with respect to said base frame.

7. The system of claim 4 wherein said means for rotating said carriage frame includes a steering wheel mounted on said wall, a shaft connected to said wheel and a relatively small gear connected to said shaft, and a relatively large gear meshed with said relatively small gear and connected to said rotatable shaft of said hub.

8. The system of claim 1 wherein said means for rotating said carriage frame includes a steering wheel mounted on said wall, a shaft connected to said wheel and a relatively small gear connected to said shaft, and a relatively large gear meshed with said relatively small gear and connected to said rotatable shaft of said hub.

9. The system of claim 8 wherein said rotatable shaft includes a longitudinal bore therethrough for the passage of control lines from the operator's side of said vertical wall to the carriage frame side of said vertical wall.

10. The system of claim 8 wherein said carriage frame includes at least one guide rod and a screw rod extending along a substantial part of its length and wherein said nozzle carriage is mounted for movement along said guide rod and said screw rod.

11. The system of claim 10 wherein said means for moving said nozzle carriage in an air motor connected to rotate said screw rod.

12. The system of claim 10 further including limit means for limiting the length of travel of said nozzle carriage along said carriage frame.

13. The system of claim 8 further including stop means for preventing the rotation of said carriage frame beyond more than about 370° in either direction of rotation.

14. The system of claim 13 wherein said stop means includes a movable stop and said carriage frame includes an abutment menas for engaging said stop at the end of its rotation in either direction.

15. The system of claim 8 further including remotely actuable brake means for locking said rotatable carriage at a desired rotational position.

16. The system of claim 1 wherein said carriage frame includes at least one guide rod and a screw rod extending along a substantial part of its length and wherein said nozzle carriage is mounted for movement along said guide rod and said screw rod.

17. The system of claim 16 wherein said means for moving said nozzle carriage is an air motor connected to rotate said screw rod.

18. The system of claim 16 further including limit means for limiting the length of travel of said nozzle carriage along said carriage frame.

19. The system of claim 1 further including stop means for preventing the rotation of said carriage frame beyond more than about 370° in either direction of rotation.

20. The system of claim 19 wherein said stop means includes a movable stop and said carriage frame includes an abutment means for engaging said stop at the end of its rotation in either direction.

21. The system of claim 1 further including remotely actuable brake means for locking said rotatable carriage at a desired rotational position.

22. The system of claim 1 further including means for adjusting the distance from said nozzle to the axis of rotation of said carriage frame.

23. The system of claim 22 further including means for pivoting said nozzle about an accurate path with respect to the axis of rotation of said carriage frame.

24. Apparatus for use in a fluid delivery system for removing material from the inside wall of a motor stator including a plurality of longitudinal grooves, comprising, in combination:

a base frame;

a vertical wall mounted on said frame whereby an operator's position is provided on said frame on one side of said wall;

a horizontally extending, longitudinal rotatable carriage frame mounted on said vertical wall and extending from the side of said vertical wall opposite the side on which said operator's position is located;

means located on the operator's side of said wall for selectively rotating said carriage frame;

a nozzle carriage mounted on said carriage frame for movement along a substantial part of the length of said carriage frame;

means for selectively causing said nozzle carriage to move along said carriage frame; and a high pressure outlet nozzle mounted on said nozzle carriage.

25. The apparatus of claim 24 wherein said vertical wall is movable vertically with respect to said base frame and further including means for selectively positioning said vertical wall at a desired vertical position with respect to said base frame.

26. The apparatus of claim 24 wherein said vertical wall includes a pluraltiy of diagonally extending support members extending upwardly and toward the center of said wall, and further including a hub supported by said support members and a rotatable shaft extending through said hub, said carriage frame being mounted for rotation with said shaft.

27. The apparatus of claim 26 wherein said vertical wall is movable vertically with respect to said base frame and further including means for selectively positioning said vertical wall at a desired vertical position with respect to said base frame.

28. The apparatus of claim 27 further including stop means for preventing the rotation of said carriage frame beyond more than about 370° in either direction of rotation.

29. The apparatus of claim 26 wherein said means for rotating said carriage frame includes a steering wheel mounted on said wall, a shaft connected to said wheel and a relatively small gear connected to said shaft, and a relatively large gear meshed with said relatively small gear and connected to said rotatable shaft of said hub.

30. The apparatus of claim 29 wherein said rotatable shaft includes a longitudinal bore therethrough for the passage of control lines from the operator's side of said vertical wall to the carriage frame side of said vertical wall.

31. The apparatus of claim 24 wherein said carriage frame includes at least one guide rod and a screw rod extending along a substantial part of its length and wherein said nozzle carriage is mounted for movement along said guide rod and said screw rod.

32. The apparatus of claim 31 wherein said means for moving said nozzle carriage is an air motor connected to rotate said screw rod.

33. The apparatus of claim 31 further including limit means for limiting the length of travel of said nozzle carriage along said carriage frame.

34. The apparatus of claim 24 further including stop means for preventing the rotation of said carriage frame beyond more than about 370° in either direction of rotation.

35. The system of claim 34 wherein said stop means includes a movable stop and said carriage frame includes an abutment means for engaging said stop at the end of its rotation in either direction.

36. The system of claim 24 further including remotely actuable brake means for locking said rotatable carriage at a desired rotational position.

37. The apparatus of claim 24 further including means for adjusting the distance from said nozzle to the axis of rotation of said carriage frame.

38. The apparatus of claim 37 further including means for pivoting said nozzle about an accurate path with respect to the axis of rotation of said carriage frame.

39. A fluid delivery system for removing material from the inside wall of a motor stator including a plurality of longitudinal grooves, comprising, in combination:

a base frame;

a vertically movable vertical wall mounted on said frame whereby an operator's position is provided on said frame on one side of said wall;

means for selectively moving said vertical wall;

a horizontally extending, longitudinal rotatable carriage frame mounted on said vertical wall and extending from the side of said vertical wall opposite the side on which said operator's position is located;

wheel means located on the operator's side of said wall for selectively rotating said carriage frame so that an operator must turn said wheel a substantial number of times to cause one revolution of said carriage frame;

a nozzle carriage mounted on said carriage frame for movement along a substantial part of the length of said carriage frame;

a rotatable shaft mounted in said nozzle carriage and movable transversely with respect to said nozzle carrier;

a high pressure outlet nozzle pivotally mounted on said rotatable shaft;

a source of high pressure fluid including a high pressure pump; and dump valve means connected between said pump and said outlet nozzle for selectively providing a high pressure blast of fluid from said outlet nozzle.

* * * * *